US009206619B1

(12) United States Patent
Savoia

(10) Patent No.: US 9,206,619 B1
(45) Date of Patent: Dec. 8, 2015

(54) APPARATUS AND METHOD FOR SECURING POSTS TO RETAINING WALLS

(71) Applicant: David Anthony Savoia, Kelowna (CA)

(72) Inventor: David Anthony Savoia, Kelowna (CA)

(73) Assignee: 9155279 CANADA LTD. (CA)

( * ) Notice: Subject to any disclaimer, the term of this patent is extended or adjusted under 35 U.S.C. 154(b) by 0 days.

(21) Appl. No.: 14/580,755

(22) Filed: Dec. 23, 2014

(51) Int. Cl.

| | |
|---|---|
| ***E02D 27/00*** | (2006.01) |
| ***E04H 17/22*** | (2006.01) |
| ***E02D 29/02*** | (2006.01) |
| ***E04B 1/41*** | (2006.01) |
| *E04B 1/38* | (2006.01) |

(52) U.S. Cl.
CPC ..... *E04H 17/22* (2013.01); *E02D 29/02* (2013.01); *E04B 1/40* (2013.01); *E04B 2001/405* (2013.01)

(58) Field of Classification Search
CPC ..... E04H 17/22; E02D 29/02; E04B 1/40; E04B 2001/405
USPC ..... 52/292, 293.1, 293.2, 293.3, 294, 296, 52/297
See application file for complete search history.

(56) References Cited

U.S. PATENT DOCUMENTS

| | | | | |
|---|---|---|---|---|
| 396,624 | A | 1/1889 | Thomas | |
| 1,438,074 | A | 12/1922 | Welch | |
| 4,120,125 | A | 10/1978 | Cvetan | |
| 4,455,795 | A | 6/1984 | Cole | |
| 4,483,506 | A | 11/1984 | Litwiller | |
| 5,123,623 | A | 6/1992 | McNamara | |
| 5,238,321 | A | 8/1993 | Jarjoura | |
| 6,308,468 | B1 | 10/2001 | Caruso | |
| 6,953,180 | B1 | 10/2005 | Ruvalcaba et al. | |
| 8,490,354 | B2 * | 7/2013 | Robinson | 52/293.2 |
| 2002/0041796 | A1 * | 4/2002 | Greenberg | 405/284 |
| 2002/0069595 | A1 * | 6/2002 | Knudson et al. | 52/102 |
| 2005/0098772 | A1 * | 5/2005 | Fuoco | 256/65.14 |
| 2006/0175593 | A1 * | 8/2006 | Wink | 256/59 |
| 2008/0277543 | A1 * | 11/2008 | Daysh et al. | 248/205.1 |
| 2011/0036026 | A1 | 2/2011 | Lee | |

FOREIGN PATENT DOCUMENTS

| | | |
|---|---|---|
| DE | 19904572 | 8/2000 |
| JP | 7-150822 | 6/1995 |
| JP | 10-212843 | 8/1998 |
| JP | 2011-108457 | 6/2011 |

* cited by examiner

*Primary Examiner* — Mark Wendell
(74) *Attorney, Agent, or Firm* — Antony C Edwards

(57) ABSTRACT

The present invention provides an apparatus and method for securing a fence post to the top of a completed retaining wall. A wall system is provided that comprises interconnected wall blocks that define a wall structure. The wall structure includes at least one internal chamber that is defined between a front face and a back face. The retaining wall system may include a support structure that is positioned at least partially between the interconnected wall blocks. The retaining wall system also includes a post bracket that is securable to the top of the wall structure. The post bracket comprises a shank portion that is extendible through the top surface and into the at least one chamber. The post bracket further comprises a flange portion that abuts the top surface. The post bracket further comprises a receptacle that extends away from the top surface for receiving a post member.

5 Claims, 4 Drawing Sheets

26

APPARATUS AND METHOD FOR SECURING POSTS TO RETAINING WALLS

FIELD OF INVENTION

This disclosure generally relates to retaining wall structures. In particular, the disclosure relates to an apparatus and method for securing posts, such as fence posts to a top surface of retaining wall structures.

BACKGROUND

Retaining walls are often built by placing a number of interconnected blocks in courses upon each other. A course of blocks is also referred to as a row of blocks. The blocks typically have interior cavities that hold drainage material. The cavities may also be referred to as cores or chambers. The drainage materials are typically drain rocks that are each about 1 cubic inch in overall size. Drainage materials are often void of fines so that plugging of the cavities can be reduced and flow of water through the retaining wall is substantially unimpeded.

Retaining walls are structurally supported by the use of a structural support material, for example geo grid. Geo grid is a mesh-like material that is often made of polypropylene or other polymers with sufficiently high tensile strengths. The geo grid is placed between one or more courses of the retaining wall. The geo grid extends away from a back face of the retaining wall and into the retained material, such as earth, rocks and soil, which is being retained by the retaining wall. The distance that the geo grid extends into the retained material may vary based upon a number factors, such as the physical stability of the retained materials, and overall mass of the retained materials, the height of the retaining wall and other factors that are known to those skilled in the art. The mesh structure of the geo grid comprises a number of holes that portions of the retained material can fit within. The weight of the retained materials and the presence of the retained materials within the holes of the geo grid contribute to the structural integrity of the retaining wall.

Securing posts, such as fence posts, to retaining walls is often desirable for safety and security. A builder can secure fence posts to a retaining wall by lag bolting a post bracket to a top cap of the retaining wall. The top cap is often adhered to the upper course of blocks by an adhesive. Then the builder will typically secure a fence post into the post bracket, and build a fence between a series of secured fence posts. While this is commonly used, it creates an unsafe scenario because the adhesive is not designed to maintain adhesion of the top cap that includes a fence thereupon. For example, the fence posts can act as a lever that can, in some cases easily, disconnect the top cap from the upper course of blocks.

Another known solution to securing fence posts to near to the top of retaining walls is to insert sonotubes into the retained material near the back face of the retaining wall. This approach includes positioning the sonotubes within the retained material, inserting the fence posts and filling the sonotubes with concrete to fix the fence posts within the sonotubes. While the use of sonotubes does not pose the same safety concerns as the previously described approach, the placement of the sonotubes within the retained material will often interfere with the structural support material. For example, the structural support material is often cut while digging the holes for the sonotubes. This may impair the structural integrity of at least a portion of the retaining wall.

U.S. Patent Publication Document No. 2008/0277543 to Daysh et al. teaches another approach for securing fence posts to the top of a retaining wall. Daysh teaches a fence post bracket that positions the fence post away from a center portion of the retaining wall blocks, when view from above. The post bracket of Daysh comprises a variety of structures that extend into the cavities of the blocks. These structures are designed to provide an increased surface area for adhering with concrete that is filled within the cavities. This is how Daysh teaches to secure the post bracket in place. The post bracket of Daysh makes it difficult to use a top cap on the retaining wall. For example, the top cap will have to be cut to provide recesses that can accommodate the post brackets and fence posts. This cutting can be meticulous and labour intensive work. Additionally, a retaining wall that secures the post brackets within the block cavities with concrete could interfere with the use drainage materials within at least the block cavities that contain a post bracket.

SUMMARY

The present invention provides an apparatus and method for securing a fence post to the top of a completed retaining wall that may include a top cap.

One example embodiment of the present invention is a retaining wall system that comprises a plurality of interconnected wall blocks that define a wall structure. The wall structure includes a front face, a back face, a bottom surface, a top surface and at least one internal chamber that is defined between the front and back face. Optionally, the top surface of the wall structure includes a top cap, which is also referred to herein as the top surface. The retaining wall system may include a support structure that is positioned at least partially between one or more of the plurality of interconnected wall blocks. The retaining wall system also includes a post bracket that is securable to the top surface of the wall structure. The post bracket comprises a shank portion that is extendible through the top surface of the wall structure and into the at least one chamber. The post bracket further comprises a flange portion that abuts the top surface. The post bracket further comprises a receptacle that extends away from the top surface and that is operable for receiving a post member. Optionally, the retaining wall system may further comprise a drilling guide for drilling one or more aligned apertures for securing the post bracket to the top surface.

Another example embodiment of the present invention is a method of securing a post member onto a wall. The method comprises the steps of: forming a shank receiving aperture on a top surface of the wall; inserting a shank portion of a post bracket into the shank receiving aperture; connecting the post bracket to the top surface of the wall; and securing an end of a post member to the post bracket. Optionally, the method may further comprise a step of aligning the shank-receiving aperture with a second aperture by using a drill guide and the second aperture is used to connect the post bracket to the top surface.

Another example embodiment of the present invention is the use of a post bracket for securing a post member to a wall structure. The post bracket comprises a shank portion, a flange portion and a receptacle portion. The use comprises the steps of inserting the shank portion into an aperture that extends through a top cap surface of the wall structure; connecting the flange portion to the top cap surface; and fixing an end of the post member within the receptacle portion so that the post member extends away from the top cap surface.

The present invention allows a user to secure fence posts upon a completed retaining wall. The present invention avoids the use of concrete applications and it does not interfere with the structural integrity of any structural support material or the drainage properties of any drainage material. The use of concrete applications typically necessitates cutting away portions of the supporting structural material to allow the concrete to flow into and through the cavities of the blocks. Before the wet concrete sets, it can seep between the blocks. It is known that wet concrete can degrade the supporting structural material. At least these two drawbacks of using concrete applications may be avoided by the present invention.

BRIEF DESCRIPTION OF DRAWINGS

Various examples of the apparatus are described in detail below, with reference to the accompanying drawings. The drawings may not be to scale and some features or elements of the depicted examples may purposely be embellished for clarity. Similar reference numbers within the drawings refer to similar or identical elements. The drawings are provided only as examples and, therefore, the drawings should be considered illustrative of the present invention and its various aspects, embodiments and options. The drawings should not be considered limiting or restrictive as to the scope of the invention.

DETAILED DESCRIPTION

As further described herein below, the present invention provides a system, method and use of a post bracket for securing a post member to a top surface of a retaining wall. With a secured post member, a fence can be built on top of the retaining wall. Advantageously, the retaining wall can be completed and the post members can be secured without the use of concrete. Furthermore, the present invention may improve the structural integrity of the retaining wall while not interfering with any structural support material, for example geo grid, that may be used in the building of the retaining wall.

Figure 1:
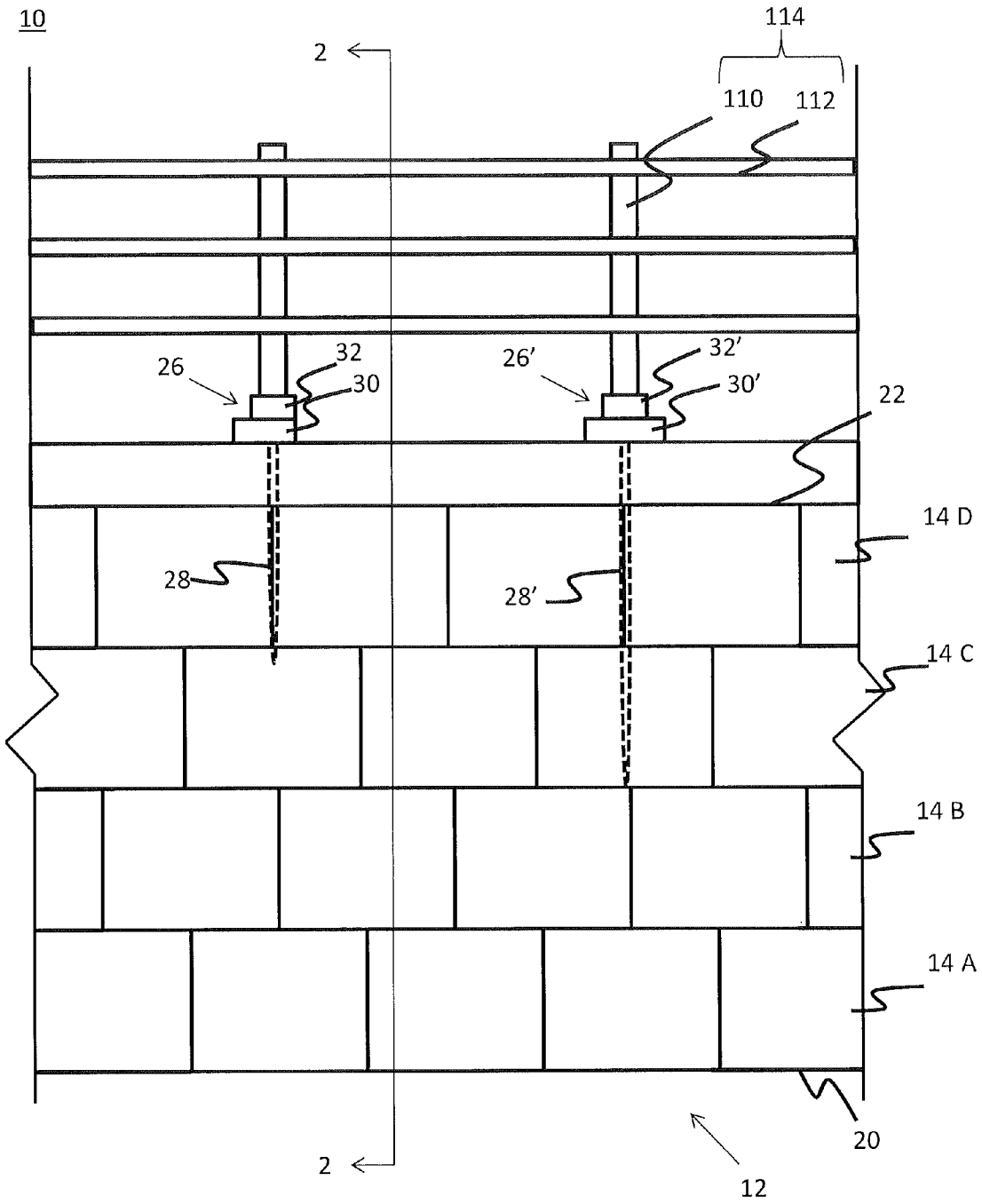
FIG. 1 is side elevation view of one example embodiment of a retaining wall system.
Figure 2:
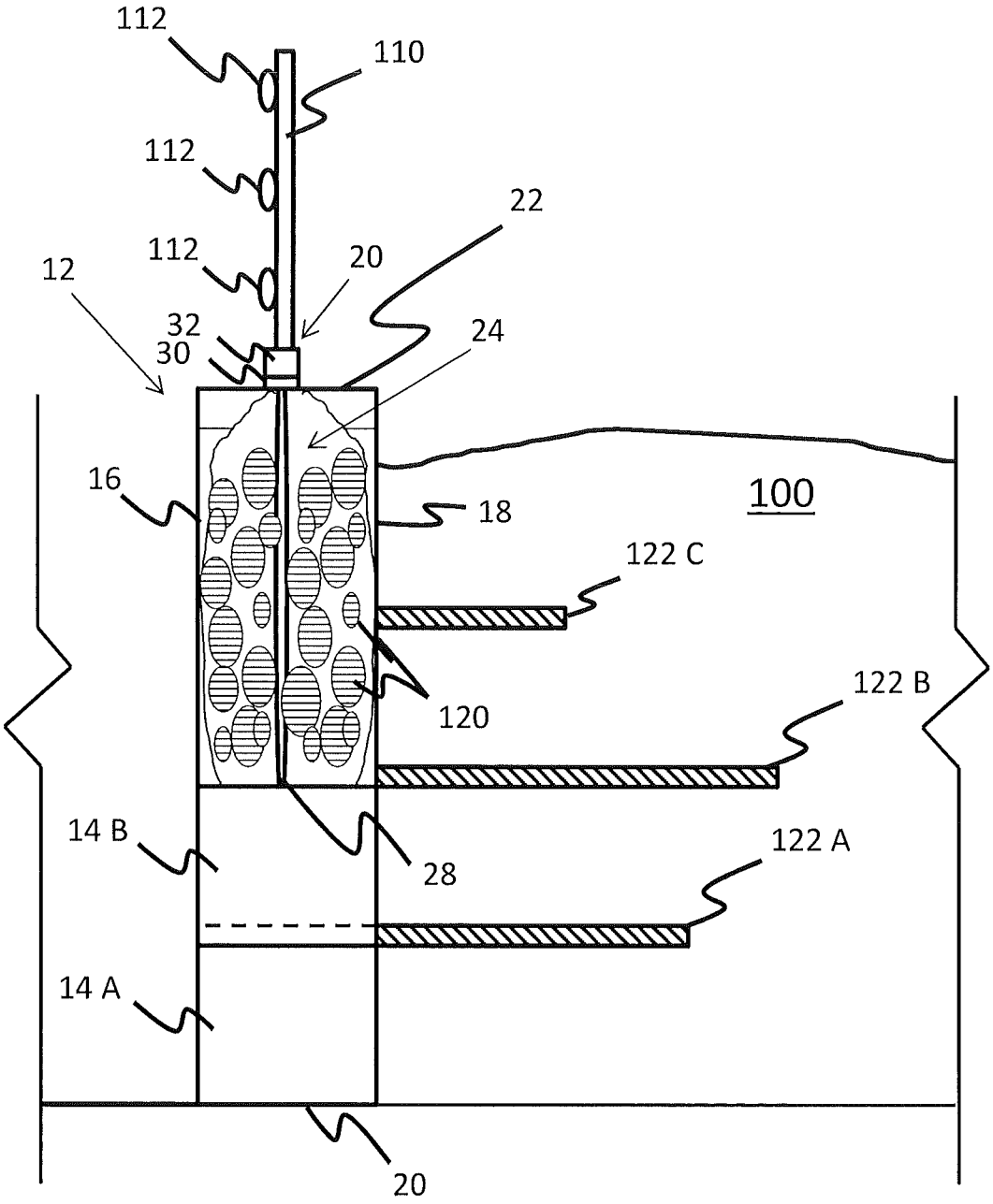
FIG. 2 is a cross-sectional view of the retaining wall system of FIG. 1, viewed generally along line 2-2.
Figure 3:
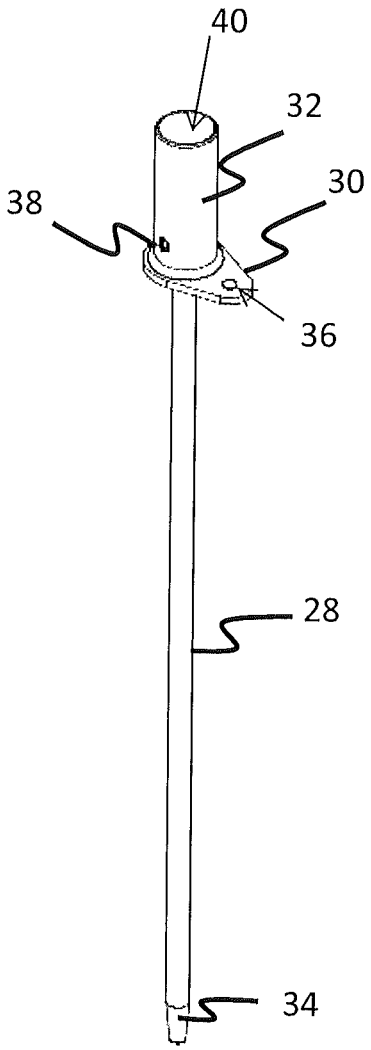
FIG. 3 is a perspective view of the example post bracket for use with the retaining wall system of FIG. 1.

FIG. 1 depicts one example embodiment of a wall retaining system 10. The retaining wall system 10 comprises a wall structure 12 that is made up of a number of block courses 14 (with each individual course depicted as 14A to 14D) and a top cap 22. Without intending to be limiting, FIG. 1 depicts four block courses (14A to 14D), however any number of block courses may be used in the construction of the wall structure 12. The block courses 14 include individual blocks, each include a number of faces, such as a front face, a back face, a lower surface and an upper surface. Accordingly, the wall structure 12 also generally includes a front face 16, a back face 18, a lower surface 20 and an upper surface 22. Each individual block defines an internal cavity 24 (as depicted in FIG. 2). Optionally, a top cap 22 can be positioned on top of the upper most upper surface 22 of the wall structure 12. The top cap 22 may also be referred to as the top surface of the wall structure 12.

The individual blocks each have at least one internal cavity 24. The internal cavity 24 can be accessed, for example to receive drainage material 120 therein, from one or more of the faces of each block. For example, the bottom and top surfaces of each individual block may have openings to the internal cavity 24 and the front and back faces may be closed off to the internal cavity 24, or vice versa. As one skilled in the art will appreciate, the definitions of the faces of the blocks provided herein are not intended to be limiting and, ultimately, the definition of a given face depends upon the orientation and final positioning of each individual block when the wall structure 12 is being constructed. In other examples of the retaining wall system 10 different types of blocks may be used, preferably the blocks include one or more faces that define an internal cavity for receiving drainage material therein.

The wall retaining system 10 may comprise a support structure 112 that is at least partially positioned between two individual wall blocks of the plurality of interconnected wall blocks. FIG. 2, which is not intended to be limiting, depicts the support structure 112 as extending away from the back face 18 of the wall structure 12 into retained material 100. The support structure 122 may be positioned between two courses of interconnected wall blocks. For example, support structure 122A is positioned between courses 14A and 14B, support structure 122B is positioned between courses 14B and 14C and support structure 122C is positioned between courses 14C and 14D. The support structures 122 are positioned between the courses 14 during the construction of the wall structure 12, as depicted by the dotted line in FIG. 2. The support structures 122 can be the same length or variable lengths and extend into the retained material 100 the same or different distances from the back face 18. While FIG. 2 depicts support structures 122 A, B and C being positioned between adjacent courses 14 of blocks, the support structures 122 can be spaced further apart, for example every 2 or 3 courses 14 of blocks. Between each course 14, the support material 122 can be positioned as close to the front face 16 as possible. Alternatively, a particular design of the wall structure 12 or particular blocks used in a particular wall structure 12 may require that the support structure 122 is spaced from the front face 16. For example, the support material 122 may be spaced from the front face 16 to ensure that the support structure 122 is not exposed and visible at the front face 16. Preferably, the support structure 122 is a mesh-like sheet of material made from a polymer, for example, polypropylene, or other polymers with a sufficiently high tensile strength. The mesh-like structure of the support structure 122 defines a number of holes (not shown) that can receive a portion of the drainage material 120 and a portion of the retained material 100 therewithin. The drainage material 120 and the retained material 100 may also be referred to as penetrating or impregnating the support structure 122. In this fashion, the drainage material 120 and the retained material 100 help maintain the desired position of the penetrated support structure 122. In turn, the penetrated support structure 122 helps keep the wall structure 12 in the desired position. Preferably, the support structure 122 is geo grid; however, other building materials are also suitable.

The drainage material 120 allows water to flow through the internal cavities 24 of the wall structure 12. For example, the drainage material may be 1 inch in overall diameter drainage rock that has a substantially smooth outer surface. However, other materials may also be suitable. Preferably, the drainage material 120 is substantially free of fine particles to reduce the formation of plugs that will impair the flow of water through the wall structure 12.

The wall retaining system 10 further comprises at least one post bracket 26 that includes a shank portion 28, a flange portion 30 and a receptacle portion 32. The flange portion 30 can be positioned on an upper surface of the top cap 22 and the shank portion 28 is elongate and extendible through the top cap 22 into the wall structure 12 below (see dotted lines in FIG. 1). The shank portion 28 can be of various lengths (contrast 28 and 28' in FIG. 1). Post brackets 26 with shank portions 28 of different, or the same, lengths may be used in the same wall system 10. Preferably, the shank portion 28 is long enough to extend through the top cap 22 and at least one course of blocks 14. More preferably, the shank portion 28 is long enough to extend through the top cap 22 and through more than one course of blocks, for example two or three courses of blocks 14. The length of the shank portion 28 may fall within a range of about 10 cm to about 100 cm. Preferably, the length of the shank portion 28 is long enough to extend through the top cap 22 and three courses of blocks and at least one layer of structural support 122, for example about 70 cm.

The shank portion 28 may have a shape that reduces or prevents the shank portion 28 from becoming caught on the drainage material 120 as the shank portion 28 is inserted into the wall structure 12. While various shapes may be suitable, preferably the shank portion 28 has a smooth outer surface that has a circular cross-sectional shape. The smooth outer surface allows the shank portion 28 to pass within the drainage material 120 without becoming caught or blocked. Optionally, the shank portion 28 may have a tip 38 that is shaped to help displace the drainage material 120 while the shank portion 28 is being inserted therein. For example, a frustoconical shaped tip 38 may be preferred over a flat tip.

The shank portion 28 may also pass through at least one hole of the support structure 122. In this fashion, the shank portion 28 will also penetrate the support structure 122 which may bolster the structural integrity of the support structure 122 and the overall wall structure 12.

The flange portion 30 is positionable on an upper surface of the top cap 22. The flange portion 30 may be any shape. The flange portion 30 may define at least one aperture 36 for receiving a connector (not shown). The connector can be inserted into the at least one aperture 36 and into another aperture (not shown) in the top cap 22 for securing the post bracket to the top cap 22. The connector can be any suitable type of connector, such as a bolt, a screw, a pin or a rod.

The receptacle portion 32 can extend away from the flange portion 30 for receiving a post member 110 within a receiving hole 40. The receptacle portion 32 can be any cross-sectional shape and any dimension to receive the post member 110 of any desired shape or size. The receptacle portion 32 can include one or more apertures 38 for receiving connectors (not shown) for securing the post member 110 within the receiving hole 40. The connectors can be any suitable type of connector, for example, a screw, a nail, a bolt, a pin or a staple. FIG. 1, which is not intended to be limiting, depicts a fence 114 that comprises a number of post members 110 and cross-rails 112. Other types of fences 114, for example chain-link fences or picket fences, are also contemplated. The type of fence 114 to be built on top of the wall structure 12 and, therefore, the type of post member 110 will generally dictate the shape and dimensions of the receptacle portion 32.

The post bracket 26 may be composed of a number of different materials, such as metal, metal alloys, rigid polymers, composite materials and combinations thereof. The post bracket 26 may be constructed as a single, monolithic structure. Alternatively, the post bracket 26 may be an aggregated structure with the shank portion 28, the flange portion 30 and the receptacle portion 32 all manufactured as individual components that are assembled and connected together. For example, if the post bracket is made of mostly metal or metal alloy individual components, then welding may be used to connect them together.

Figure 4:
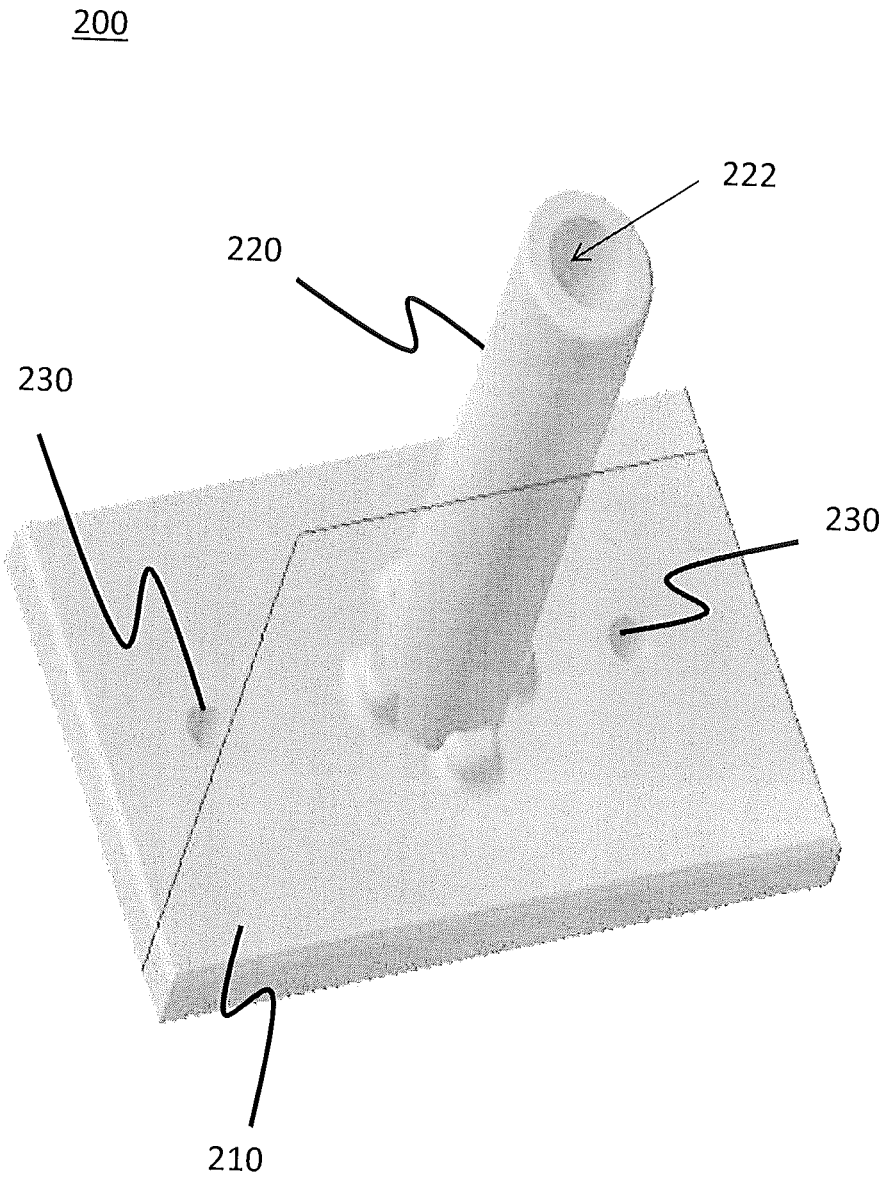
FIG. 4 is a perspective view of an example embodiment of a drill guide for use with the example post bracket of FIG. 1.

FIG. 4, without intending to be limiting, depicts an example embodiment of a drill guide 200. The drill guide 200 comprises a planar portion 210 and a guide arm 220. The guide arm 220 has a primary guide hole 222. The planar portion 210 has one or more secondary guide holes 230. The drill guide 200 can also be referred to as a jig, a template or a stencil. The drill guide 200 allows a user to drill apertures in the top cap 22 so that the shank portion 28 can be inserted into the top cap 22 and so that connectors can be used to secure the flange portion 30 to the top cap 22. For example, the primary guide hole 222 may be spaced from the secondary guide holes 230 substantially the same distance that the outer edge of the shank portion 28 is distanced from apertures 36 on the flange portion 30. Additionally, the drill guide 200 and, in particular, the primary guide hole 222 is substantially perpendicular to the flange portion 30. In this manner, the drilling of the shank-receiving hole may be substantially perpendicular to the top surface of the top cap 22.

The present invention also provides a method of securing a post member 110 onto a wall structure 12. The method comprises the steps of drilling a shank-receiving aperture on a top surface of the wall structure 12 and inserting the shank portion 28 of the post bracket 28 into the shank-receiving aperture. Optionally, the method further comprises a step of levelling the top cap 22 so that the shank-receiving aperture is substantially perpendicular to the top cap 22 and, therefore, the shank-receiving aperture may be substantially vertical. The next step of the method is connecting the post bracket 26 to the top surface of the wall structure 12, which is followed by securing the post member 110 to the post bracket 26. The inventor has observed that this method may be advantageous for securing post members 110 onto already completed wall structures 12.

The step of drilling the shank-receiving aperture through the top cap 22 is most typically performed using a masonry drill bit. The shank-receiving aperture has a diameter that is large enough to receive the shank portion 28 and that is deep enough to penetrate through at least the top cap 22. Preferably, the diameter of the shank-receiving aperture is closely matched with the cross-sectional area of the shank portion 28 so that the shank portion 28 fits within the shank-receiving aperture with a minimal space between the shank portion 28 and the inner diameter of the shank-receiving aperture. Optionally, the diameter of the shank-receiving aperture may be slightly smaller than the cross-sectional area of the shank portion 28 so that a friction fit is formed to help maintain the position of the shank portion 28 within the shank-receiving aperture. Optionally, the user can use the drill guide 200 to drill through the top cap 22 to form the shank-receiving aperture and another set of apertures that align with the apertures 36 of the flange portion 30.

The user then inserts the shank portion 28 into the shank-receiving aperture and connects the post bracket 28 to the top cap 22. As described above, the post bracket 28 can be connected to the top cap 22 via connectors that are inserted through the one or more apertures 36 of the flange portion 30. Alternatively, the post bracket 28 may be connected to the top cap 22 by other means, such as adhesives, concrete or other brackets and connectors.

The user then secures an end of the post member 110 to the post bracket 28. For example, a connector may be inserted through aperture 38 into the end of the post member 110 that is positioned within the receiving hole 40. If the post member 110 is made of wood, then nails or screws may be preferred. If the post member 110 is made of metal, or a metal alloy, pins or bolts may be preferred.

While the above disclosure describes certain examples of the present invention, various modifications to the described examples will also be apparent to those skilled in the art. The scope of the claims should not be limited by the examples provided above; rather, the scope of the claims should be given the broadest interpretation that is consistent with the disclosure as a whole.

What is claimed is:

1. A retaining wall system comprising:

a. a plurality of interconnected wall blocks that define a wall structure that comprises a front face, a back face, a lower surface, an upper surface and at least one chamber that is defined between the front face and back face;

b. a top cap that is positionable on top of the upper surface of the wall structure for covering the at least one chamber from above, the top cap defining at least one shank receiving aperture that, when the top cap is on top of the upper surface of the wall structure, extends through the top cap to communicate with the at least one chamber;

c. a post bracket that is securable to the top cap of the wall structure, the post bracket comprising:

i. a shank portion that is extendible through the shank receiving aperture of the top cap into the at least one chamber;

ii. a flange portion that abuts the top cap of the wall structure; and iii. a receptacle that is extendible away from the top cap of the wall structure, wherein the receptacle is operable for receiving a post member, wherein the plurality of interconnected wall blocks further define a plurality of block courses of the wall structure; wherein the system further comprises a support structure that is at least partially positionable between two adjacent block courses and wherein the support structure is extendible away from the back face of the wall structure.

2. The retaining wall system of claim 1, wherein the support structure defines at least one aperture and the shank portion, when in the at least one chamber, is receivable within at least one aperture of the support structure when positioned between the two adjacent block courses.

3. The retaining wall system of claim 1, wherein the flange portion defines one or more apertures each for receiving a connector for connecting the flange portion to the top cap.

4. The retaining wall system of claim 1, further comprising a drainage material that is positionable within the at least one chamber.

5. The retaining wall system of claim 4, wherein the shank portion has a smooth outer surface for passing the shank portion through the drainage material within the at least one chamber.

* * * * *